US008640488B2

(12) United States Patent
Shaha et al.

(10) Patent No.: US 8,640,488 B2
(45) Date of Patent: Feb. 4, 2014

(54) ICE BIN ASSEMBLY

(75) Inventors: Bipin Shaha, Louisville, KY (US); Arun Talegaonkar, Louisville, KY (US); Charlsie Lemons, Louisville, KY (US); Jeremiah O. Crane, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 430 days.

(21) Appl. No.: 13/149,455

(22) Filed: May 31, 2011

(65) Prior Publication Data

US 2012/0304684 A1 Dec. 6, 2012

(51) Int. Cl.
*F25D 3/02* (2006.01)

(52) U.S. Cl.
USPC ..... 62/459; 62/344

(58) Field of Classification Search
USPC ..... 62/66, 137, 340, 344, 459, 381
See application file for complete search history.

(56) References Cited

U.S. PATENT DOCUMENTS

| | | | | |
|---|---|---|---|---|
| 6,425,259 | B2 * | 7/2002 | Nelson et al. | 62/344 |
| 6,655,166 | B1 * | 12/2003 | Williams | 62/320 |
| 6,952,936 | B2 | 10/2005 | Sannasi et al. | |
| 7,395,672 | B2 | 7/2008 | Krause et al. | |
| 7,707,847 | B2 | 5/2010 | Davis et al. | |
| 2004/0163405 | A1 * | 8/2004 | Jung | 62/344 |
| 2007/0084230 | A1 * | 4/2007 | Krause et al. | 62/344 |
| 2009/0107166 | A1 * | 4/2009 | Sowers et al. | 62/344 |

* cited by examiner

*Primary Examiner* — Melvin Jones
(74) *Attorney, Agent, or Firm* — Dority & Manning, P.A.

(57) ABSTRACT

In certain embodiments of the present disclosure, an ice bin assembly for a refrigerator is described. The ice bin assembly further includes an ice storage container having at least one upper guide element and at least one lower guide element. The upper guide element is located above a plane that intersects a center of mass of the ice storage container and the lower guide element is located below the plane that intersects the center of mass of the ice storage container. The upper guide element is configured to contact the upper docking element when the ice storage container is seated on the base and the lower guide element is configured to contact the lower docking element when the ice storage container is seated on the base.

20 Claims, 16 Drawing Sheets

ICE BIN ASSEMBLY

FIELD OF THE INVENTION

The present disclosure relates to an ice bin assembly.

BACKGROUND OF THE INVENTION

Ice dispensers have been used in conventional household refrigerators for many years. Such dispensers can include an external discharge opening formed on a door of the refrigerator convenient for a user to fill a glass with ice without opening the door. An ice bin is typically provided that receives and stores ice cubes from an ice maker. When dispensers are present, ice can be transferred to an opening in communication with a chute. The ice is transferred through the chute to the discharge opening. In order to move ice pieces to the opening and chute, a horizontal wire auger having a helically coiled portion is positioned lengthwise in the ice bin. The rear end of the wire auger is connected to a driving motor.

The driving motor includes a base which receives the ice bin and ensures that the auger is properly seated against the driving motor and that the ice bin opening is properly seated in the chute. Alternatively, when ice is not dispensed through an ice dispenser, a base is still present to ensure that an ice bin is properly seated in the refrigerator. However, the ice bin must also be capable of being repeatedly removed from and reinserted onto the base and the refrigerator by a user. Unfortunately, conventional base components make ice bin removal and reinsertion difficult and inconvenient.

Accordingly, an ice bin assembly that allows for easier removal and reinsertion of an ice bin would be desirable. A refrigerator incorporating such an ice bin assembly would be particularly useful.

BRIEF DESCRIPTION OF THE INVENTION

Aspects and advantages of the disclosure will be set forth in part in the following description, or may be obvious from the description, or may be learned through practice of the disclosure.

In certain embodiments of the present disclosure, an ice bin assembly for a refrigerator is described. The refrigerator includes a refrigerator compartment. The ice bin assembly includes a base having at least one upper docking element and at least one lower docking element. The ice bin assembly further includes an ice storage container having at least one upper guide element and at least one lower guide element. The upper guide element is located above a plane that intersects a center of mass of the ice storage container and the lower guide element is located below the plane that intersects the center of mass of the ice storage container. The upper guide element is configured to contact the upper docking element when the ice storage container is seated on the base and the lower guide element is configured to contact the lower docking element when the ice storage container is seated on the base.

In still other embodiments of the present disclosure, a refrigerator is described. The refrigerator includes a refrigerator body having a refrigerator compartment and an ice bin assembly. The ice bin assembly includes a base having at least one upper docking element and at least one lower docking element. The ice bin assembly further includes an ice storage container having at least one upper guide element and at least one lower guide element. The upper guide element is located above a plane that intersects a center of mass of the ice storage container and the lower guide element is located below the plane that intersects the center of mass of the ice storage container. The upper guide element is configured to contact the upper docking element when the ice storage container is seated on the base and the lower guide element is configured to contact the lower docking element when the ice storage container is seated on the base.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure, including the best mode thereof, directed to one of ordinary skill in the art, is set forth in the specification, which makes reference to the appended figures, in which.

DETAILED DESCRIPTION OF THE INVENTION

Figure 1:
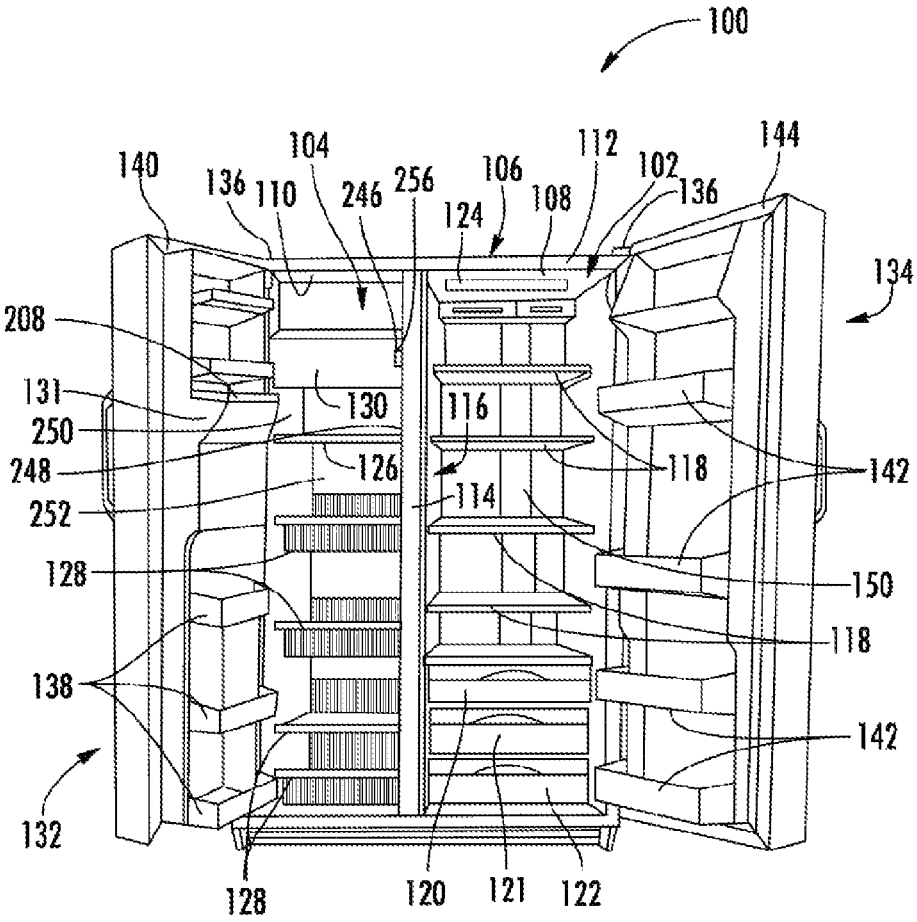
FIG. 1 provides a perspective exploded view of a refrigerator in accordance with certain aspects of the present disclosure.

The present disclosure relates to an ice bin assembly for a refrigerator. The ice bin assembly includes a base having at least two docking elements. The ice bin assembly further includes an ice storage container (also referred to herein as a "bin" or "bucket") having at least two guide elements. Each guide element is configured to contact a corresponding docking element when the ice storage container is seated on the base. In this manner, the ice bin assembly of the present disclosure greatly improves ease of removal and reinsertion of the ice storage container. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

FIG. 1 illustrates an exemplary refrigeration appliance 100 in which the present invention may be practiced. In the embodiment described and illustrated herein, appliance 100 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 100 includes a fresh food storage compartment 102 and a freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylonitrile-butadiene-styrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 may partly form a quick chill and thaw system (not shown) and selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104.

Freezer compartment 104 includes an automatic ice maker 130. An ice dispenser (not shown) is connected to discharge chute 131 and is provided in freezer door 132 so that ice can be obtained without opening freezer door 132. As will become evident below, ice maker 130, in accordance with conventional ice makers includes a number of electromechanical elements that manipulate a mold to shape ice as it freezes, a mechanism to remove or release frozen ice from the mold, and a primary ice bucket for storage of ice produced in the mold. Periodically, the ice supply is replenished by ice maker 130 as ice is removed from the primary ice bucket. The storage capacity of the primary ice bucket is generally sufficient for normal use of refrigerator 100.

Freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
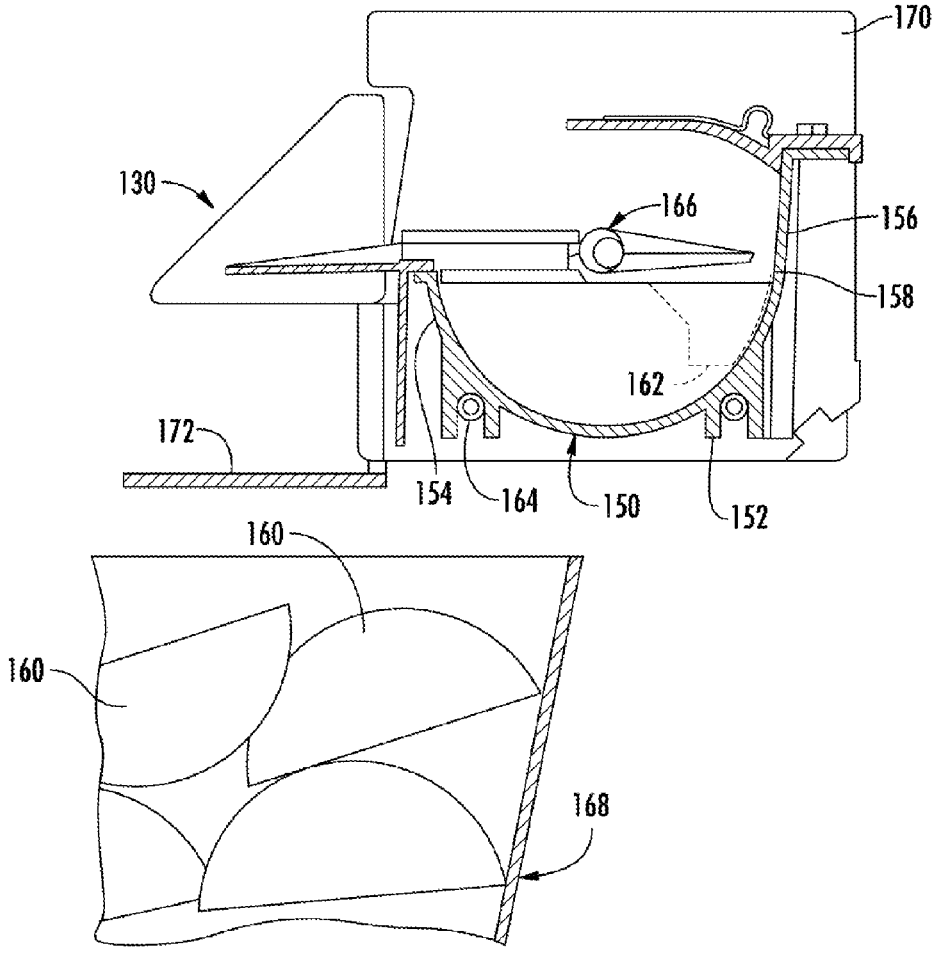
FIG. 2 is a cross-sectional view of an ice maker in the refrigerator shown in FIG. 1 in accordance with certain aspects of the present disclosure.

FIG. 2 is a cross sectional view of an icemaker 130 including a metal mold 150 with a tray structure having a bottom wall 152, a front wall 154, and a back wall 156. A plurality of partition walls 158 extend transversely across mold 150 to define cavities in which ice pieces 160 are formed. Each partition wall 158 includes a recessed upper edge portion 162 through which water flows successively through each cavity to fill mold 150 with water.

A sheathed electrical resistance heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve (not shown in FIG. 2) connected to a water source (not shown) and delivering water to mold 150 through an inlet structure (not shown).

In order to sense a level of ice pieces 160 in storage bin, 168 controller actuates a cam-driven feeler arm 172 rotates underneath icemaker 130 and out over storage bin 168 as ice is formed. Feeler arm 172 is spring biased to an outward or "home" position that is used to initiate an ice harvest cycle, and is rotated inward and underneath icemaker by a cam slide mechanism (not shown) as ice is harvested from icemaker mold 150 so that the feeler arm does not obstruct ice from entering storage bin 168 and to prevent accumulation of ice above the feeler arm. After ice is harvested, the feeler arm is rotated outward from underneath icemaker 130, and when ice obstructs the feeler arm and prevents the feeler arm from reaching the home position, controller 170 discontinues harvesting because storage bin 168 is sufficiently full. As ice is removed from storage bin 168, feeler arm 172 gradually moves to its home position, thereby indicating a need for more ice and causing controller 170 to initiate formation and harvesting of ice pieces 160.

Referring again to FIG. 1, an ice dispenser (not shown) is connected to discharge chute 131 and is provided in freezer door 132 so that ice can be obtained without opening freezer door 132. Dispenser includes an inlet 208, an ice discharge conduit or chute 131, and a chute door (not shown) moveable between an open position and a closed position for passing ice therethrough. Chute 131 is in communication with inlet (not shown) and discharging outlet (not shown) outside refrigerator door 132 (shown in FIG. 1). In use, ice enters chute 131 through inlet 208 and is channeled through chute 131 to outlet upon activation of a paddle (not shown).

Figure 3:
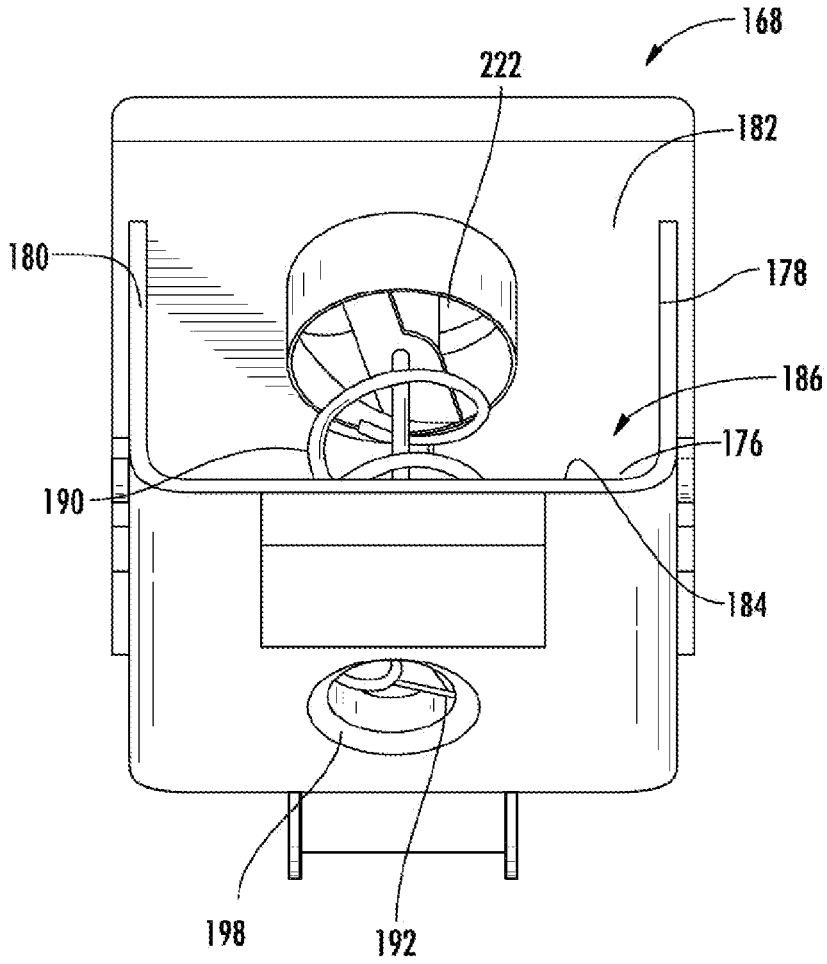
FIG. 3 is a top perspective view of the ice bucket shown in FIG. 2 in accordance with certain aspects of the present disclosure.
Figure 4:
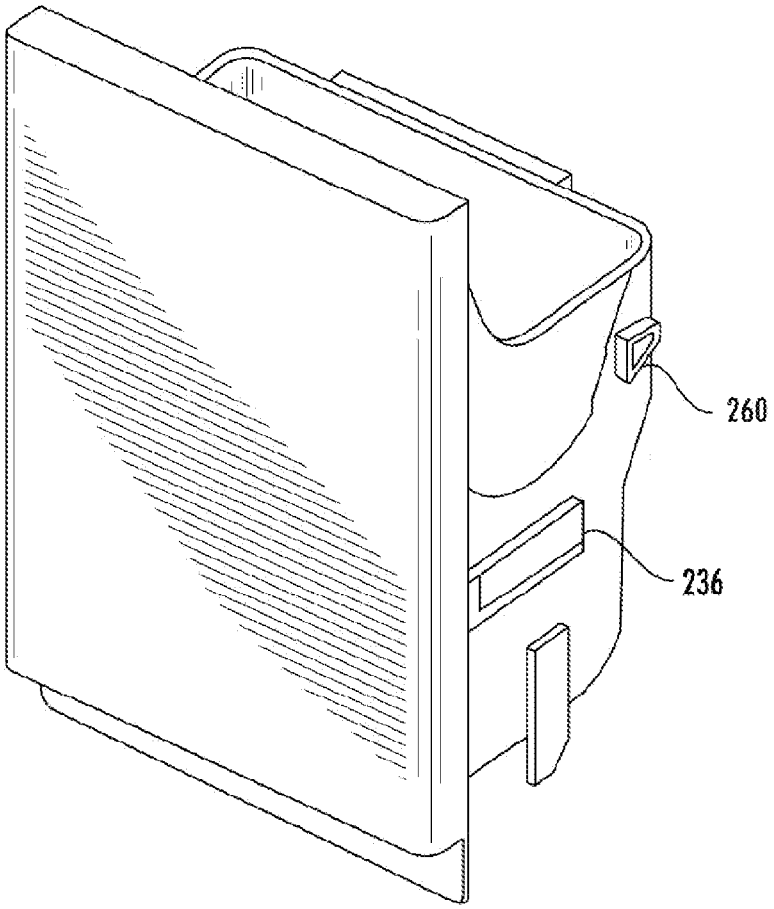
FIG. 4 is a front perspective view of the ice bucket shown in FIG. 3 in accordance with certain aspects of the present disclosure.
Figure 6A:
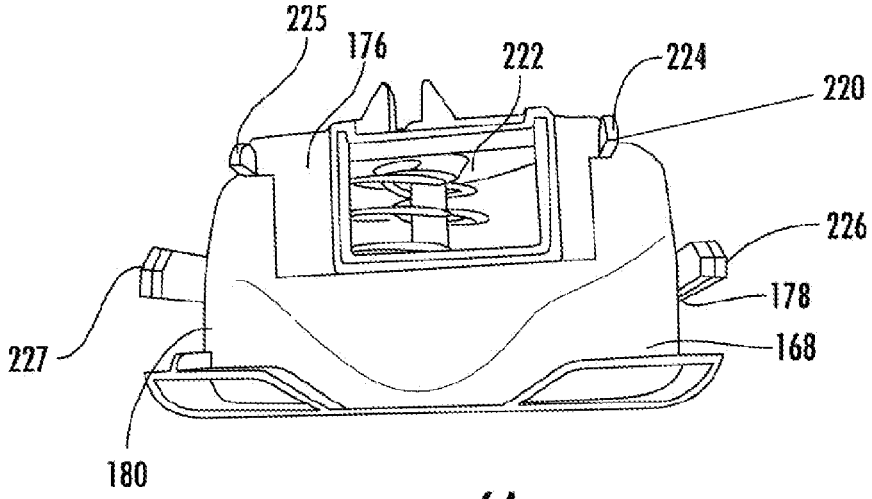
FIG. 6A is a bottom view of the ice bucket shown in FIG. 4 in accordance with certain aspects of the present disclosure.

FIG. 3 is a top perspective view of ice bucket 168 and FIG. 4 is a front perspective view of ice bucket 168. Referring to FIGS. 3 and 4, ice bucket 168 includes a bottom wall 176, opposing side walls 178 and 180, a front wall 182, and a back wall 184. Bottom wall 176, side walls 178 and 180, front wall 182, and back wall 184 define an ice collection cavity 186. As illustrated in FIG. 6A, discharge opening 222 is defined through the bottom 176 of ice bucket 168. A rotatable auger 190 extends between front and back walls 182 and 184.

Again, however, it should be appreciated that ice bucket can be mounted in any location of a refrigerator, including but not limited to a freezer cabinet, freezer door of a side by side refrigerator, an ice freezing compartment in the fresh food compartment or fresh food door, a bottom freezer or a side by side or a top mount refrigerator, or the like. As such, ice bucket may or may not include discharge opening or one or more other elements described in association with the exemplary embodiments.

Auger 190 is operatively coupled to an auger drive cup 192 so that when drive cup 192 is turned, auger 190 also turns. Drive cup outer surface 198 is rotatably coupled to back wall 184. Particularly, drive cup 192 is positioned in an opening (not shown) in bucket back wall 184.

Figure 5:
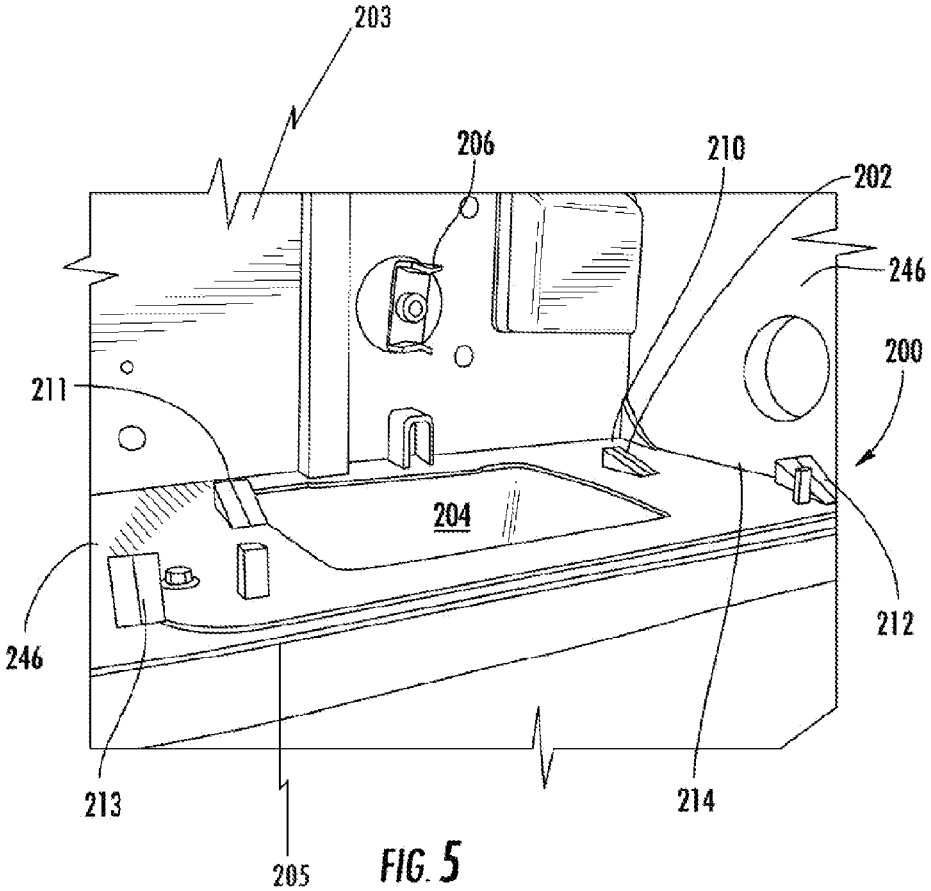
FIG. 5 is a front perspective view of a base in accordance with certain aspects of the present disclosure.

Referring to FIG. 5, a perspective view of a base 200 for seating the ice bucket in refrigerator is illustrated. Base 200 can be configured to cover drive motor (not shown). FIG. 5 shows drive fork 206 before engagement with drive cup 192 and before ice bucket 168 is seated on base 200. A drive fork 206 operatively coupled to a drive motor can engage drive cup 192 to turn auger 190. Base 200 can define an opening 204 that is aligned with inlet 208 of discharge chute 131 (as shown in FIG. 1) of dispenser, which is coupled to refrigerator door 132. As described above, dispenser is arranged within refrigerator door 132, such that ice can be delivered into dispenser and to a user when door is in a closed position.

Base 200 can be positioned underneath ice maker 130 and can be configured to receive ice bucket 168. For instance, base 200 can be located between refrigerator walls 246. In addition, one or more components described herein in association with base 200 can be formed separately from base as part of refrigerator walls 246. Known ice buckets sometimes become unseated during use or auger operation. Also, known ice buckets sometimes do not reliably seat properly, holding the freezer door partially open. Referring again to FIG. 5, base 200 includes one or more lower docking elements 202. Lower docking elements 202 can maintain positive seating of ice bucket 168 during operation when used in combination with lower guide elements 220 as further described herein.

For instance, referring to FIG. 5, base includes two lower docking elements 210, 211 that are each positioned on either side of opening 204 and/or closer to rear wall 203. Optionally, base can also include lower docking elements 212, 213 that are each positioned adjacent to edges of base 214 near refrigerator walls 246 and/or closer to front edge 205 of base. As an example, a side view of base 200 is illustrated in FIGS. 9A-9E in which lower docking element 211 can be seen positioned adjacent to rear wall 203 and lower docking element 213 can be seen positioned adjacent to front edge 205 of base. Although not shown, lower docking elements 210 and 212 can be similarly situated on the opposite side of base that is not visible in FIGS. 9A-9E. Alternatively, as seen in FIGS. 11A-11F, only lower docking elements 210 and 211 (not visible) are present. However, any suitable location on base is contemplated for lower docking elements 202.

Lower docking elements can have any suitable shape to assist in seating ice bucket 168. For instance, lower docking elements 202 can have a generally sloped surface. Referring to FIGS. 7 and 10A-10D, in certain embodiments of the present disclosure, lower docking elements can have a first surface 216 having a generally flat profile and a second surface 218 have a raised profile such as a L-shaped profile.

Referring to FIGS. 9A-9E, 10A-10D, and 11A-11F, base can also include one or more upper docking elements 250. Upper docking elements 250 can maintain positive seating of ice bucket 168 during operation when used in combination with upper guide elements 260 as further described herein. In this regard, upper docking elements 250 can have any suitable shape that allows upper docking element in combination with upper guide element to seat ice bucket. For instance, as illustrated, upper docking element includes a downwardly sloped surface 252 which has a raised surface 254 rising therefrom so as to form a hook profile.

Upper docking elements 250 can be located along rear wall 203 of base 200 and/or along one or one or more refrigerator walls 246 that are present on either side of base 200. Upper docking elements can be located above drive fork 206. From the side view in the above indicated figures, a single upper docking element can be seen although a second similarly situated upper docking element is also present on the opposite side of base that is not visible.

Figure 6B:
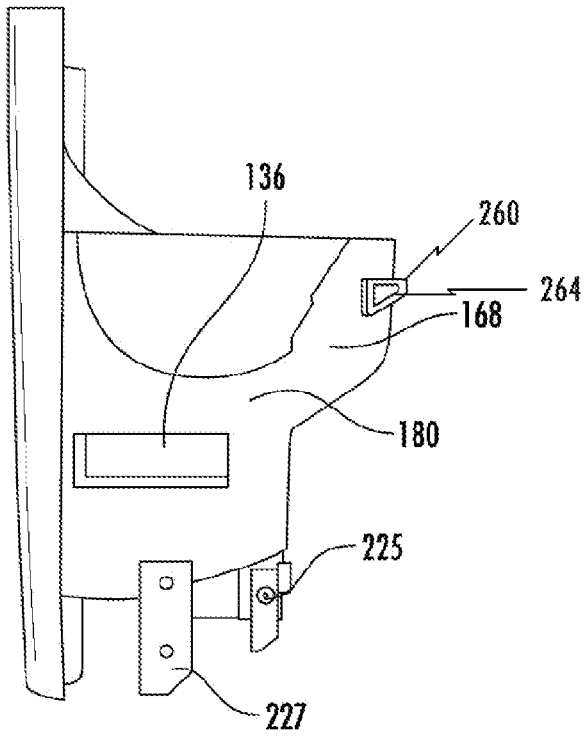
FIG. 6B is a side view of the ice bucket shown in FIG. 6A in accordance with certain aspects of the present disclosure.
Figure 7:
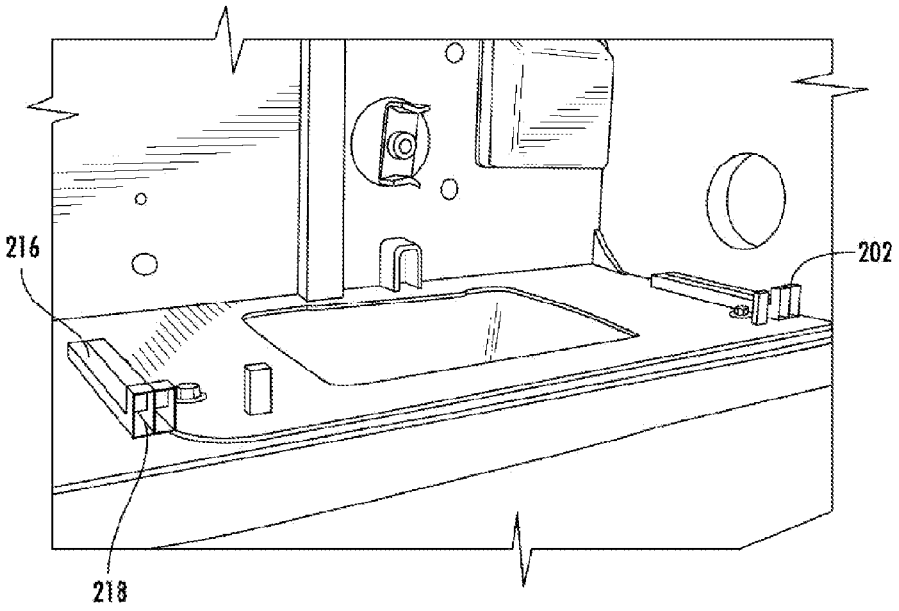
FIG. 7 is a front perspective view of a base in accordance with certain aspects of the present disclosure.

Turning to FIGS. 6A and 6B, a bottom view and side view of an ice bucket 168 configured to be movably received on base 200 is illustrated. Ice bucket 168 includes one or more lower guide elements 220 that engage corresponding lower docking elements 202. Lower guide elements 220 are each positioned on either side of discharge opening 222. Discharge opening 222 is substantially aligned and in communication with inlet 208 of discharge chute and opening 204 of base and provides access to ice bucket 168 for discharging ice.

Figure 8:
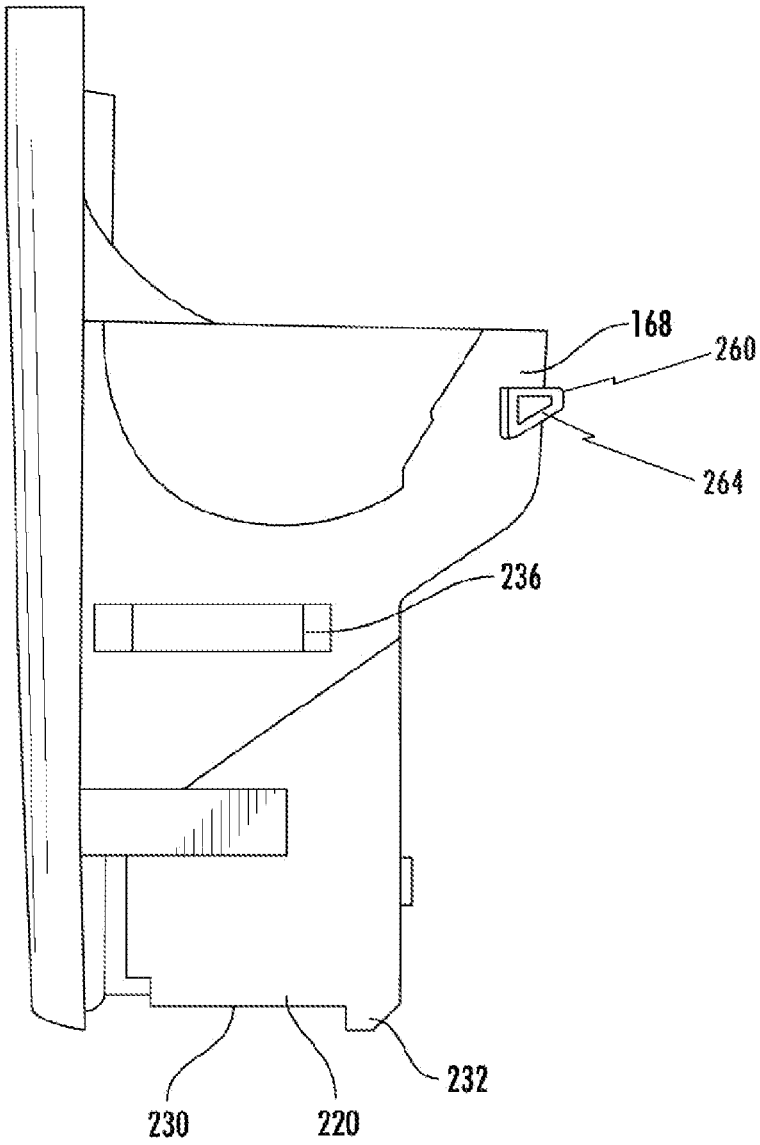
FIG. 8 is a side view of an ice bucket in accordance with certain aspects of the present disclosure.
Figure 9A:
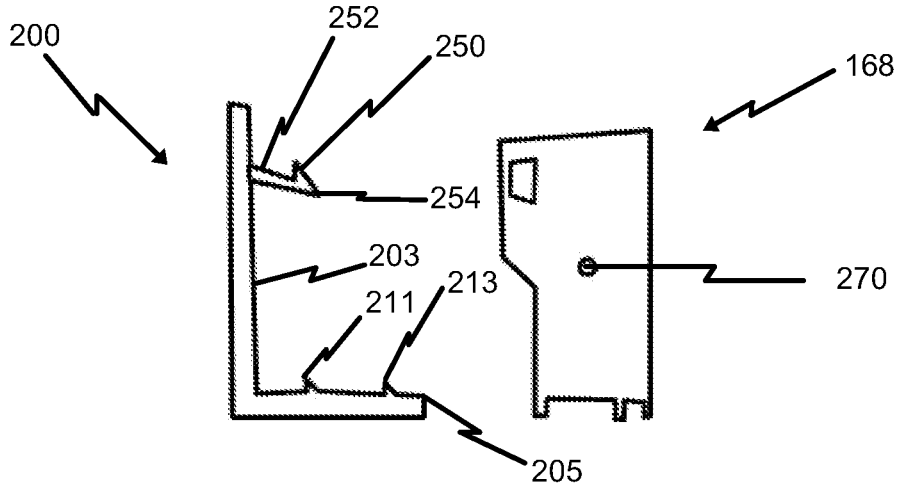
FIGS. 9A-9E, 10A-10D, and 11A-11F are side views of an ice bucket being seated on a base in accordance with certain aspects of the present disclosure.
Figure 9B:
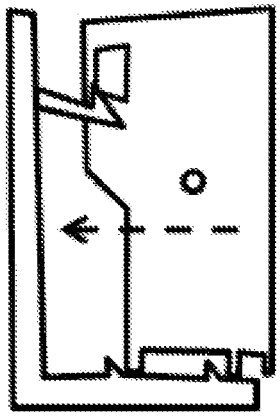
Figure 9C:
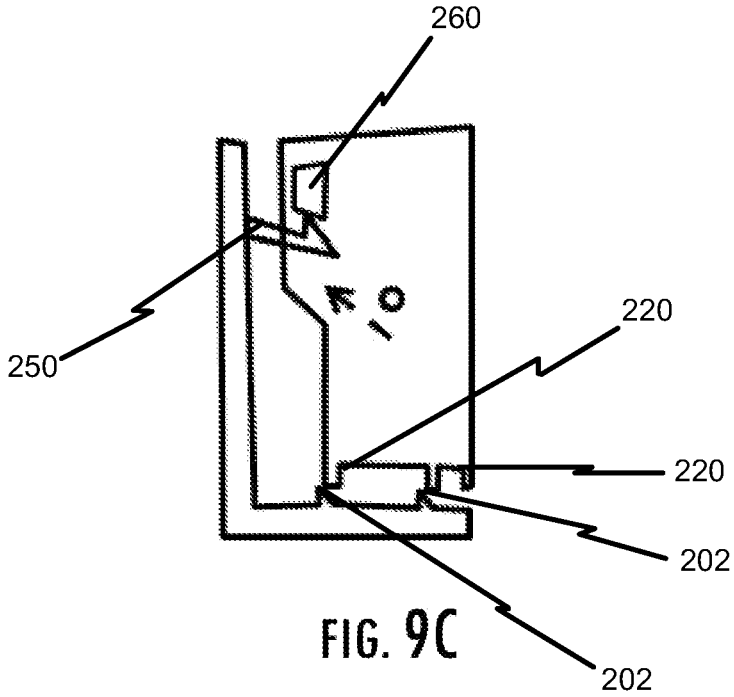
Figure 9D:
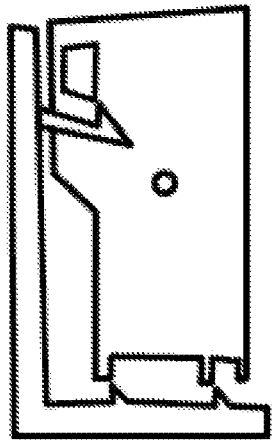
Figure 9E:
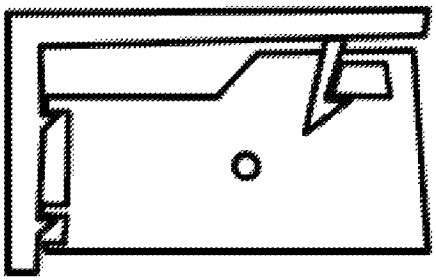
Figure 10A:
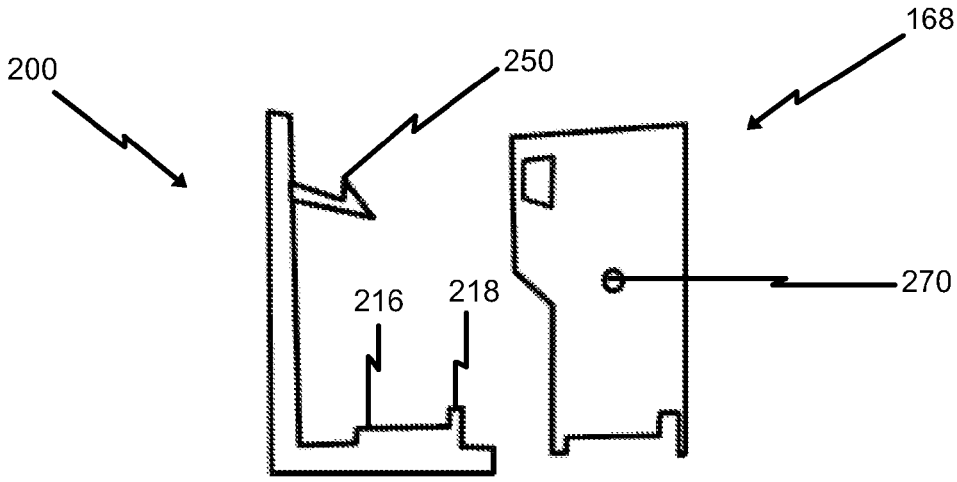
Figure 10B:
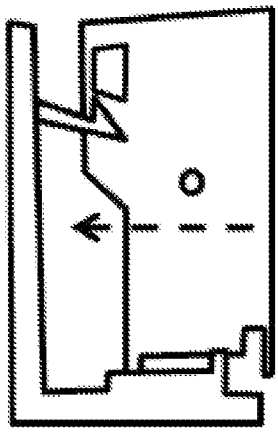
Figure 10C:
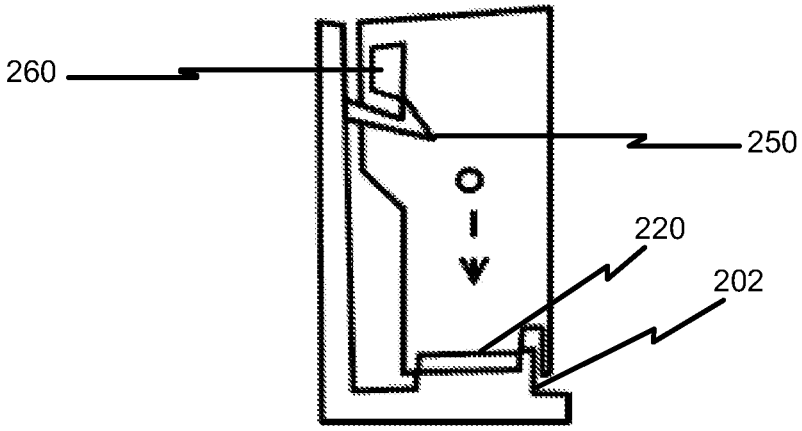
Figure 10D:
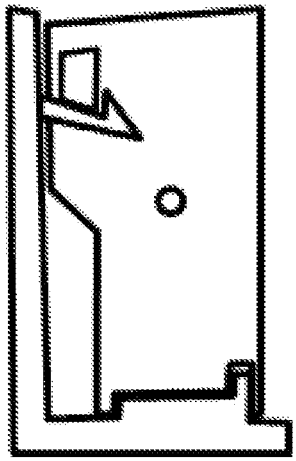

Referring again to FIGS. 6A and 6B, two lower guide elements 224, 225 can be positioned adjacent to discharge opening 222 at bottom 176 of ice bucket 168 closer to back wall 184 (shown in FIG. 3) than front wall 182 (also shown in FIG. 3). Optionally, in certain embodiments, two lower guide elements 226, 227 are located on or near side walls 178, 180 and/or bottom 176 of ice bucket 168 closer to front wall 182 than back wall 184. Lower guide elements 220 can have any suitable shape to assist in seating ice bucket 168. For instance, each lower guide element 220 can have a generally sloped surface that corresponds to the slope of corresponding lower docking elements 202. Referring to FIG. 8, in certain embodiments of the present disclosure, guide elements can have a first surface 230 having a generally flat profile and a second surface 232 have a raised profile such that guide elements can interlock with lower docking elements 202 such as those described in relation to FIG. 7.

Turning to FIGS. 6B and 8, side views of an ice bucket 168 configured to be movably received on base 200 is illustrated.

Ice bucket 168 includes one or more upper guide elements 260 that engage corresponding upper docking elements 250. Upper guide elements 260 are each positioned on either side of base 200 alongside walls 178, 180.

Referring again to FIGS. 6B and 8, two upper guide elements 264, 268 (not shown) can be positioned on each wall 180, 178 (not shown) respectively, and adjacent to back wall 184 (shown in FIG. 3) of ice bucket 168. Upper guide elements 260 can have any suitable shape to assist in seating ice bucket 168. For instance, each upper guide element 260 can have a generally sloped surface that corresponds to the slope of corresponding upper docking elements 250.

Generally, upper guide elements 260 are located above a plane defined by the center of gravity 270 of ice bucket 168 (shown in FIGS. 9A, 10A, and 11A) while lower guide elements are located below such plane. The present disclosure also adds matching features both in front and rear of the center of gravity of the bucket assembly in such a way that the weight of the bucket is taken advantage of to ensure that the ice bucket remains vertically aligned at all times.

The interface between upper docking elements 250 and upper guide elements 260 as well as between lower docking elements 202 and lower guide elements 220 greatly improves the ease of removal and reinsertion of ice bucket 168 onto base 200 and assists in preventing unseating of ice bucket 168 during operation.

FIGS. 9A-9E illustrate side views of an ice bucket and the steps associated with such an ice bucket being seated on a base in accordance with certain aspects of the present disclosure. As the ice bucket 168 is moved towards the base 200, upper docking elements 250 engage upper guide elements 260 and lower docking elements 202 engage lower guide elements 220. The issue of improper assembly can be avoided by the presently described configuration of features that will facilitate a vertical orientation of the ice bucket and allow for ease of placement of the ice bucket on the base. The features are designed so that the bucket retains a vertical orientation automatically as the locking features are brought into engagement. These features also serve to prevent the ice bucket from settling down (into the locked position) if the features are not in alignment.

Similar steps are illustrated in FIGS. 10A-10D and 11A-11F in association with different embodiments of the present disclosure. For example, the ice bucket 168 and base 200 of FIGS. 10A-10D represents that shown in FIGS. 7 and 8. As the ice bucket 168 is moved towards the base 200, upper docking elements 250 engage upper guide elements 260 and lower docking elements 202 engage lower guide elements 220.

Figure 11A:
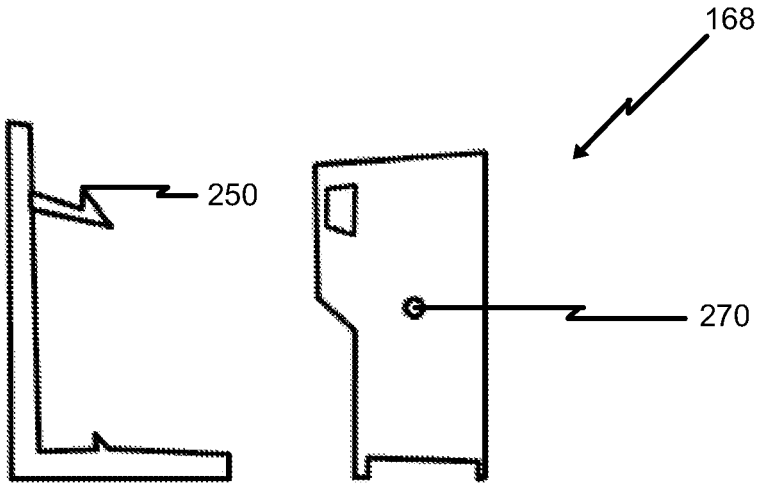
Figure 11B:
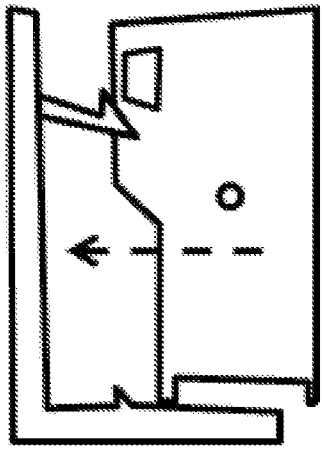
Figure 11C:
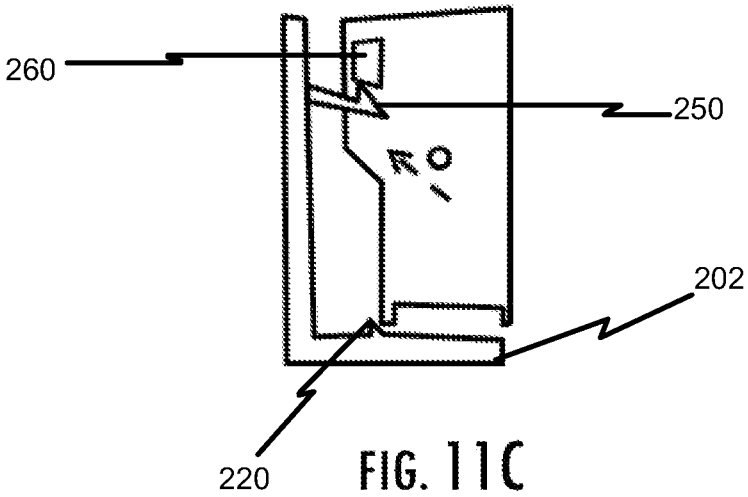
Figure 11D:
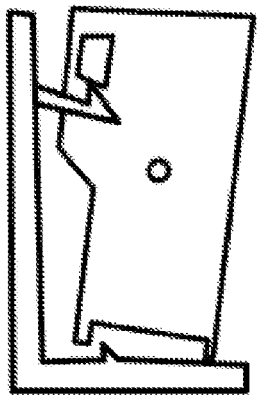
Figure 11E:
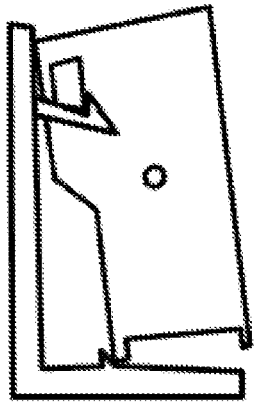
Figure 11F:
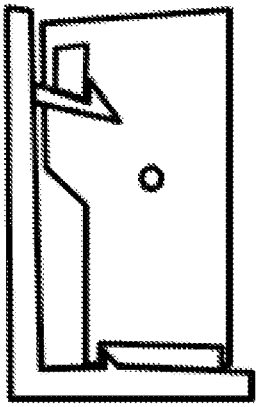

Turning to FIGS. 11A-11F, an ice bucket and the steps associated with such an ice bucket being seated on a base are illustrated with FIGS. 11D and 11F illustrating that the ice bucket will not settle into a locked position unless the features 250, 260, 202, 220 are in proper alignment.

In addition, one or more guard elements 236 can be positioned on each side wall 178, 180 of ice bucket 168. For instance, referring to FIGS. 4, 6B, and 8, a guard element 236 is illustrated on each respective side wall (the opposite side wall is not visible) of ice bucket 168, respectively. Guard elements can have any suitable shape so as to assist in properly seating the ice bucket 168 on base 200. For instance, guard elements can have a generally rectangular shape as illustrated but any suitable shape is contemplated for use in connection with the present disclosure. In operation, guard elements 236 can come into contact with refrigerator walls 246 to ensure proper alignment of ice bucket 168 on base 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice bin assembly for a refrigerator having a refrigerator compartment, the ice bin assembly comprising:

a base comprising at least one upper docking element and at least one lower docking element; and an ice storage container comprising at least one upper guide element and at least one lower guide element, the upper guide element being located above a plane that intersects a center of mass of the ice storage container and the lower guide element being located below the plane that intersects the center of mass of the ice storage container, wherein the upper guide element is configured to contact the upper docking element when the ice storage container is seated on the base and the lower guide element is configured to contact the lower docking element when the ice storage container is seated on the base.

2. An ice bin assembly as in claim 1, wherein the refrigerator comprises a door for providing access to the refrigerator compartment, the door comprising a dispenser having an inlet, wherein the base further defines an opening oriented to be substantially aligned with the dispenser inlet.

3. An ice bin assembly as in claim 2, wherein the ice storage container defines a discharge opening oriented to be substantially aligned with the base opening and the dispenser inlet when the ice storage container is seated on the base.

4. An ice bin assembly as in claim 3, wherein a lower docking element is positioned adjacent to the base opening and wherein a lower guide element is positioned adjacent to the ice storage container discharge opening.

5. An ice bin assembly as in claim 1, wherein each guide element has a shape that mates with a shape of its corresponding docking element.

6. An ice bin assembly as in claim 1, wherein the ice storage container further comprises two side walls joined together by a front wall, back wall, and bottom wall.

7. An ice bin assembly as in claim 6, wherein an upper guide element is positioned on each side wall.

8. An ice bin assembly as in claim 6, wherein at least two lower guide elements are positioned on the bottom wall.

9. An ice bin assembly as in claim 6, wherein at least four lower guide elements are positioned on the bottom wall.

10. An ice bin assembly as in claim 8, wherein at least one lower guide element positioned on the bottom wall is positioned more close to the front wall than the back wall and wherein at least one lower guide element positioned on the bottom wall is positioned more close to the back wall than the front wall.

11. A refrigerator comprising:

a refrigerator body comprising a refrigerator compartment; and an ice bin assembly comprising:

a base comprising at least one upper docking element and at least one lower docking element; and an ice storage container comprising at least one upper guide element and at least one lower guide element, the upper guide element being located above a plane that intersects a center of mass of the ice storage container and the lower guide element being located below the plane that intersects the center of mass of the ice storage container, wherein the upper guide element is configured to contact the upper docking element when the ice storage container is seated on the base and the lower guide element is configured to contact the lower docking element when the ice storage container is seated on the base.

12. A refrigerator as in claim 11, wherein a lower guide element defines a sloped surface.

13. A refrigerator as in claim 11, wherein a lower guide element defines a generally L-shaped surface.

14. A refrigerator as in claim 11, wherein an upper guide element defines a generally sloped surface.

15. A refrigerator as in claim 11, wherein each guide element has a shape that mates with a shape of its corresponding docking element.

16. A refrigerator as in claim 11, wherein the ice storage container further comprises two side walls joined together by a front wall, back wall, and bottom wall.

17. A refrigerator as in claim 16, wherein an upper guide element is positioned on each side wall.

18. A refrigerator as in claim 16, wherein at least two lower guide elements are positioned on the bottom wall.

19. A refrigerator as in claim 16, wherein at least four lower guide elements are positioned on the bottom wall.

20. A refrigerator as in claim 18, wherein at least one lower guide element positioned on the bottom wall is positioned more close to the front wall than the back wall and wherein at least one lower guide element positioned on the bottom wall is positioned more close to the back wall than the front wall.

* * * * *